United States Patent [19]

Senda et al.

[11] Patent Number: 4,706,584

[45] Date of Patent: Nov. 17, 1987

[54] CONTROL UNIT FOR PROVIDING SEAM LENGTH CONTROL OF A SEWING MACHINE

[75] Inventors: Yutaka Senda, Aichi; Katsuhiko Sato, Nagoya; Tetsuo Kozawa, Toyoake; Etsuzo Nomura, Kasugai; Yasuo Sakakibara, Hekinan, all of Japan

[73] Assignee: Brother Kogyo Kabushiki Kaisha, Nagoya, Japan

[21] Appl. No.: 877,834

[22] Filed: Jun. 24, 1986

[30] Foreign Application Priority Data

Jun. 29, 1985 [JP] Japan ..... 60-143623

[51] Int. Cl.[4] ..... D05B 19/00; D05B 27/22

[52] U.S. Cl. ..... 112/121.11; 112/315; 112/275

[58] Field of Search ..... 112/275, 277, 315, 262.1, 112/121.11, 121.12, 2, 272, 314

[56] References Cited

U.S. PATENT DOCUMENTS

| | | | |
|---|---|---|---|
| 4,359,953 | 11/1982 | Martell et al. | 112/275 X |
| 4,381,719 | 5/1983 | Goldbeck | 112/121.11 |
| 4,403,558 | 9/1983 | Martell et al. | 112/121.11 |
| 4,404,919 | 9/1983 | Martell et al. | 112/315 X |
| 4,491,080 | 1/1985 | Hager | 112/275 |
| 4,495,877 | 1/1985 | Willenbacher | 112/315 X |
| 4,545,310 | 10/1985 | Treadwell et al. | 112/315 X |
| 4,602,577 | 7/1986 | Kothe et al. | 112/315 X |

*Primary Examiner*—Peter S. Nerbun
*Attorney, Agent, or Firm*—Jordan and Hamburg

[57] ABSTRACT

Herein disclosed is a control unit for providing seam length control of a sewing machine which comprises: a main shaft; a sewing needle in accordance with the rotations of the main shaft for forming stitches in a work fabric which is placed on a work supporting surface so that it may be sewn; a feed dog for feeding the work fabric while passing a sewing point of the sewing needle; a work feed mechanism including a feed bar for carrying the feed dog and a feed shaft for supporting the feed carriage, the work feed mechanism being adapted to impart motions in a feeding direction to the feed dog by the reciprocating rotations of the feed shaft in accordance with the rotations of the main shaft; and mechanical adjusting means interposed between the work feed mechanism and the main shaft for adjusting a feed pitch of the feed dog by changing the reciprocating stroke of the feed shaft. The control unit comprises: means for setting a predetermined seam length; a signal generator provided on the work feed mechanism between the feed dog and the feed shaft for generating a signal corresponding to the moving stroke of the feed dog in the feed direction; means for comparing the signal outputted from the signal generator with a signal corresponding to the set seam length; and means for changing the feed pitch of at least a final seam when the compared value reaches a predetermined value.

17 Claims, 15 Drawing Figures

CONTROL UNIT FOR PROVIDING SEAM LENGTH CONTROL OF A SEWING MACHINE

BACKGROUND OF THE INVENTION

1. Field of the Invention

The present invention relates to a sewing machine composed of: a main shaft; a sewing needle for forming stiches; a feed dog for feeding a work fabric to be sewn; a work feed mechanism for imparting motions in a feeding direction to the feed dog; and mechanical adjusting means for adjusting a feed pitch of the feed dog and, more particularly, to a control unit for providing seam length control to effect sewing having a length accurately coincident with a predetermined sewing length by detecting the motions of said feed dog in the feeding direction and by changing the feeding pitch of at least a final stitch.

2. Description of the Prior Art

In each of the specifications of U.S. Pat. Nos. 4,359,953 and 4,403,558, there is disclosed a control unit for controlling the seam length and the end point of work fabric by counting the number of stitches after the end of the work fabric has been detected by means of a sensor. In the specification of U.S. Pat. No. 4,404,919, on the other hand, there is disclosed in addition to the above-specified control unit a unit for changing the length of a final stitch such that the reverse mechanism of a sewing machine is operated by a micro processor on the basis of the rotational angle of an electric motor when the work end is detected. In the specification of U.S. Pat. No. 4,381,719, moreover, there is disclosed a sewing machine in which a stitch counter for setting a desired number of stitches is equipped with a correcting unit for correcting the stitch number after the detection of the work end.

Any of the seam length control units disclosed in those specifications adopts a method for controlling the number of stitches. Generally speaking, however, a work feeding mechanism is constructed by connecting a number of parts. As a result, when the sewing machine is run at a high speed, the parts themselves are warped in accordance with the increasing inertia, and tolerances and clearances between each two of the parts are deflected toward the parts having higher moving velocities until they are accumulated. This reduces responsiveness between each two of the parts to elongate the work feeding pitch. When the running speed of the sewing machine drops at the end of the sewing operation, on the contrary, the work feeding pitch is slightly shortened, as compared with the previous one. As a result, the stitch number controlling method of the prior art is accompanied by a problem that no accurate coincidence is provided between the actual seam length and a set seam length even if the practised stitch number is coincident with a set stitch number. According to the stitch number controlling method, moreover, in case the work feeding pitch is changed in the course of the sewing operation, the seam length fails to coincide with the desired value even if the sewing operation of a stitch number coincident with the set value is executed. This makes it necessary to correct again the stitch number in a manner to follow the change in the pitch, thus raising a disadvantage that the control system of the sewing machine is complicated.

In the specification of U.S. Pat. No. 4,491,080, there is disclosed a pulse generator for generating pulses corresponding to the momentum of a feed dog in the work feeding direction. This pulse generator is mounted on a shaft which is made rotatable in synchronism with the main shaft of the sewing machine. Between the former shaft and the feed dog, there is arranged a horizontal work feed mechanism for transporting the feed dog in a horizontal direction. This horizontal work feed mechanism is equipped therein with a pitch adjustor for adjusting the work feeding pitch by the feed dog. To this pitch adjustor, there is connected a potentiometer for detecting the magnitude of the pitch. This potentiometer and the aforementioned pulse generator are connected with a setting counter through a micro processor.

This micro processor calculates a desired stitch number by dividing a desired seam length by the work feeding pitch given from the potentiometer and calculates the total number of pulses to be set in the aforementioned setting counter by multiplying that stitch number by a pulse number necessary for executing one stitch. And, the micro processor subtracts the number of pulses output by the aforementioned pulse generator from that total pulse number to stop the feeding operation of the feed dog when the subtracted value becomes zero.

In the machine disclosed in that specification of U.S. Pat. No. 4,491,080, however, since the pulse generator is positioned so far apart from the feed dog that a number of parts are interposed in between, the responsiveness of any two of the parts drops to disable the pulse generator like the foregoing prior art machines to generate pulses which accurately correspond to the momentum in the feeding direction of the feed dog. As a result, the seam length controlled on the basis of the pulse number coming from that signal generator becomes slightly longer or shorter than the desired one in accordance with the running speed of the sewing machine. In this machine, moreover, since the pitch adjustor is interposed between the feed dog and the pulse generator, in order to set the aforementioned setting counter with an accurate total pulse number corresponding to the desired seam length, it is necessary to monitor the magnitude of the pitch at all times by the potentiometer and to input again that value to the micro processor, and this necessity disadvantageously complicates the construction and program of the control system.

SUMMARY OF THE INVENTION

An object of the present invention is to provide a control unit for providing seam length control of a sewing machine, which can provide a seam length accurately coincident with a set seam length without being adversely affected by the running speed of the sewing machine and the change in a work feeding pitch.

Another object of the present invention is to provide a control unit for providing seam length control of a sewing machine, which can effect an accurate sewing operation by means of a simple control system.

Still another object of the present invention is to provide a control unit for providing seam length control of a sewing machine, which can improve the precision of sewing a work end portion to provide a sewn product of excellent appearance.

A further object of the present invention is to provide a control unit for providing seam length control of a playback sewing machine, which can finish a number of sheets of work fabric to be sewn by reproducing an accurate seam length.

In order to achieve the above-specified objects, according to a first aspect of the present invention, there is provided, in a sewing machine comprising: a main shaft; a sewing needle in accordance with the rotations of the main shaft for forming stitches in a work fabric which is placed on a work supporting surface so that it may be sewn; a feed dog for feeding the work fabric while passing a sewing point of the sewing needle; a work feed mechanism including a feed bar for carrying the feed dog and a feed shaft for supporting the feed carriage, the work feed mechanism being adapted to impart motions in a feeding direction to the feed dog by the reciprocating rotations of the feed shaft in accordance with the rotations of the main shaft; and mechanical adjusting means interposed between the work feed mechanism and the main shaft for adjusting a feed pitch of the feed dog by changing the reciprocating stroke of the feed shaft, a control unit for providing seam length control, comprising: means for setting a predetermined seam length; a signal generator provided on the work feed mechanism between the feed dog and the feed shaft for generating a signal corresponding to the moving stroke of the feed dog in the feed direction; means for comparing the signal output from the signal generator with a signal corresponding to the set seam length; and means for changing the feed pitch of at least a final seam when the compared value reaches a predetermined value.

According to a second aspect of the present invention, there is provided, in a sewing machine comprising: a main shaft; a sewing needle in accordance with the rotations of the main shaft for forming stitches in a work fabric which is placed on a work supporting face so that it may be sewn; a feed dog for feeding the work fabric while passing a sewing point of the sewing needle; a work feed mechanism including a feed bar for carrying the feed dog and a feed shaft for supporting the feed carriage, the work feed mechanism being adapted to impart motions in a feeding direction to the feed dog by the reciprocating rotations of the feed shaft in accordance with the rotations of the main shaft; and mechanical adjusting means interposed between the work feed mechanism and the main shaft for adjusting a feed pitch of the feed dog by changing the reciprocating stroke of the feed shaft, a control unit for providing seam length control, comprising: a work end detector for detecting the end of the work fabric in a position closer to a work feeding side than said sewing point; means for setting the length of the work fabric from the end to the sewing end position thereof; a signal generator provided on the work feed mechanism between the feed dog and the feed shaft for generating a signal corresponding to the moving stroke of the feed dog in the feed direction; means for comparing the signal output from the signal generator after the detection of the work end with a signal corresponding to the set length; and means for changing the feed pitch of at least a final seam when the compared value reaches a predetermined value.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIG. 2 is a perspective view showing a work feed mechanism of the sewing machine;

FIGS. 3(*a*), 3(*b*) and 3(*c*) are partially sectional views showing a work feed adjusting mechanism;

FIG. 4 is a partially sectional view showing a manual operating portion of the adjusting mechanism;

FIG. 5 is a block diagram showing a control circuit of the sewing machine;

FIG. 6 is a flow chart showing an operation for controlling a seam length; and FIG. 7 is a top plan view of work fabric to be sewn for showing stitches formed by the control unit of the present invention.

FIG. 8 is a perspective view showing a portion of a mechanism for stopping the work fabric feeding operation of a feed dog;

FIG. 9 is a block diagram showing only a portion of a control circuit; and

FIG. 10 is a flow chart showing an operation.

FIG. 11 is a perspective view showing a portion of the same;

FIG. 12 is a top plan view showing a portion of the same; and

FIG. 13 is a sectional view showing a portion of the same.

DESCRIPTION OF THE PREFERRED EMBODIMENTS

(First Embodiment)

The present invention will be described in the following in connection with its first embodiment, which is embodied by a playback sewing machine capable of executing a play back sewing operation on the basis of sewing data stored in advance by a trial sewing operation, with reference to FIGS. 1 to 7.

Figure 1:
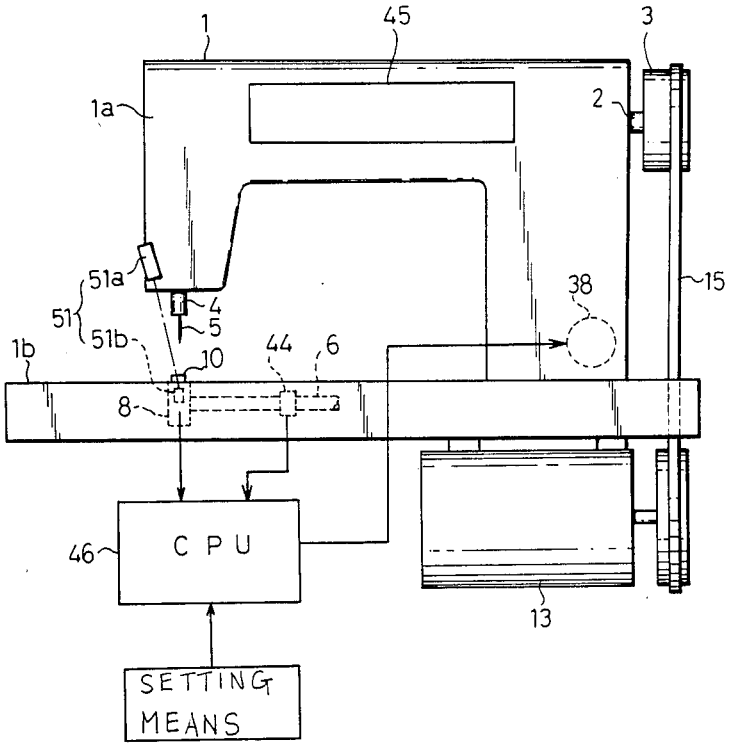
FIG. 1 is a schematic front elevation showing a control unit for providing seam length control of a sewing machine according to the present invention in a manner to correspond to the claims attached hereto.

As shown in FIG. 1, there is rotatably borne in an arm 1*a* of a machine frame 1*a* main shaft 2, to the right-hand end of which a pulley 3 is fixed. In the arm 1*a* of the machine frame 1, there is vertically movably borne a needle bar 4, to the lower end of which a needle 5 is attached. Below a bed 1*b* of the machine frame 1 forming a work supporting surface, on the other hand, there is disposed a motor 13 which is connected to the aforementioned pulley 3 through a belt 15. In accordance with the rotations of the main shaft 2 by the drive of the motor 15, moreover, the aforementioned needle 5 is moved up and down through work fabric (although not shown) placed on the bed 1*b* so that it may coact with a not-shown loop taker disposed in the bed 1*b* to form lock stitches in the work fabric. As a result, the aforementioned needle 5 and loop taker constitute together a stitch forming mechanism.

Figure 2:
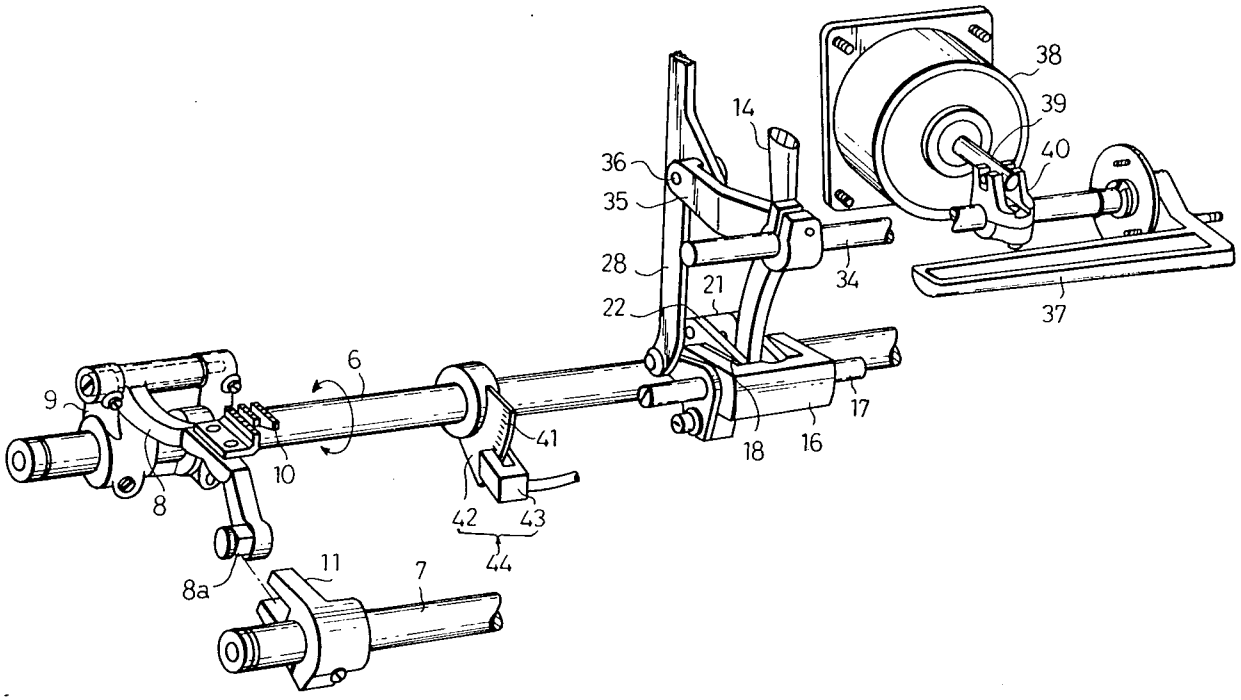
In FIGS. 2 to 7 showing a first embodiment embodying the present invention.

In the bed 1*b* of the aforementioned machine frame 1, as shown in FIG. 2, there are rotatably supported a horizontal feed shaft 6 and a vertical feed shaft 7 which extend horizontally in parallel to each other. On the lefthand end of the horizontal feed shaft 6, there is supported movably through a support arm 9 a feed bar 8, on the upper surface of which is carried such a feed dog 10 as can move inward from the upper surface of the bed 1*b*. To the lefthand end of the aforementioned vertical feed shaft 7, there is fixed a bifurcated arm 11 which engages with an engagement portion 8*a* formed at the front end of the feed bar 8. Thus, the horizontal and vertical feed shafts 6 and 7 are reciprocally rotated in accordance with the rotations of the aforementioned main shaft 2 so that the aforementioned feed dog 10 is driven horizontally and vertically to intermittently feed the work fabric on the bed 1*b* in accordance with the horizontal motions thereof.

Figure 3C:
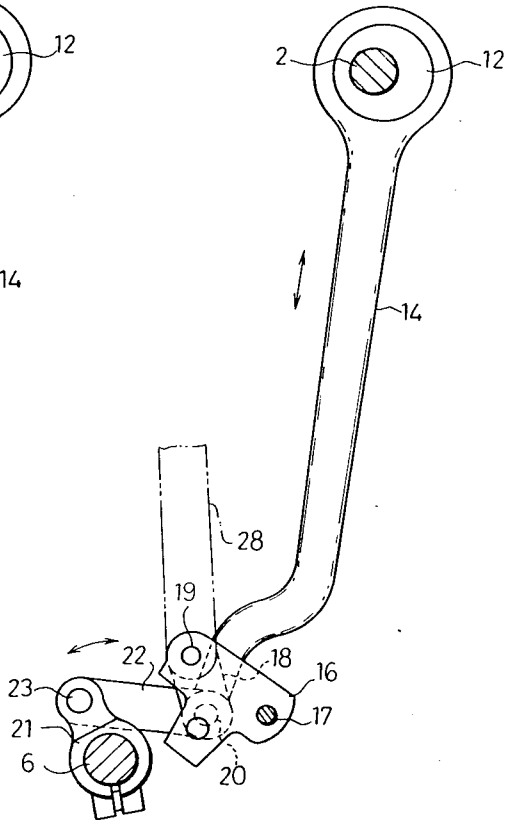
Figure 3B:
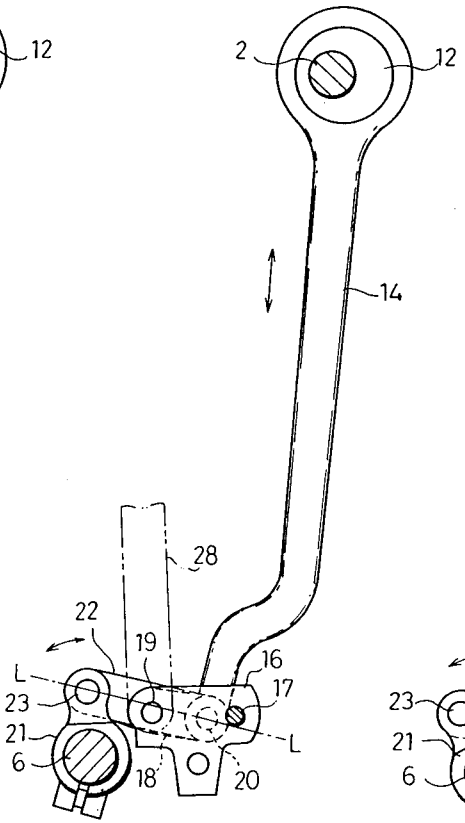
Figure 3A:
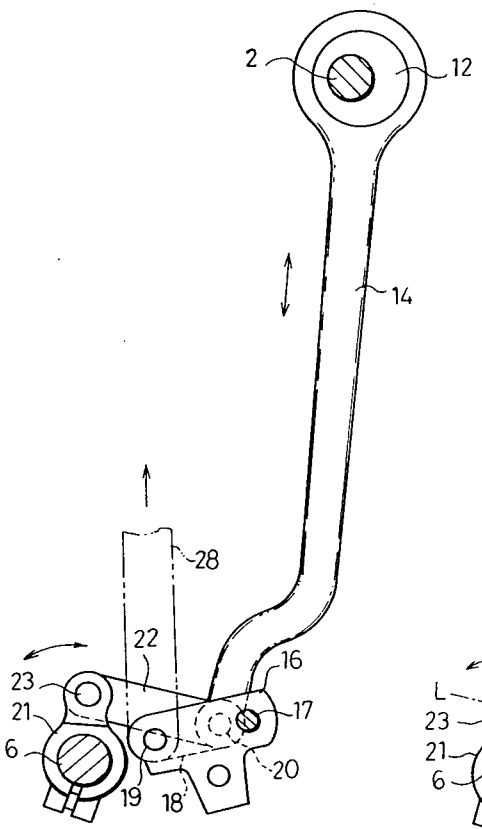

As shown in FIG. 3, more specifically, there is mounted on the aforementioned main shaft 2 an eccentric cam 12 for horizontal feed, on the upper end of which a crank rod 14 is fitted. In the bed 1*b* of the machine frame 1, there is rotatably borne through a pivot pin 17 a feed switch 16 which corresponds to the lower end of the crank rod 14. Between the rear end portions of the feed switch 16, there is rotatably borne through a pivot pin 19 a rocker lever 18 which has its front end connected in a rocking manner to the lower end of the aforementioned crank rod 14 through a connecting pin 20. At the back of the feed switch 16, there is fixed on the aforementioned horizontal feed shaft 6 a connecting arm 21. Between the upper end of this connecting arm 21 and the front end of the aforementioned rocker lever 18, there is connected a connecting lever 22 through a pin 23 and the aforementioned connecting pin 20. When the eccentric cam 12 for horizontal feed is rotated with the support pin 19 being set and arranged in a predetermined position by the rotational adjustment of the aforementioned feed switch 16, the rocker lever 18 is vertically reciprocated on the support pin 19 by the crank rod 14 so that forward and backward rocking forces are imparted to the connecting arm 21 by the connecting lever 22 in dependence on the set position of the support pin 19 to reciprocally rotate the horizontal feed shaft 6 within a predetermined range. As a result, the aforementioned horizontal feed shaft 6, feed bar 8, crank rod 14 and feed switch 16 constitute together a work feed mechanism of the present embodiment so that motions in the feeding direction are imparted to the aforementioned feed dog 10 in accordance with the reciprocating rotations of the aforementioned horizontal feed shaft 6.

Incidentally, a not-shown eccentric cam for vertical feed is mounted on the aforementioned main shaft 2, and a crank rod for vertical feed is connected between that eccentric cam and the aforementioned vertical feed shaft 7. When this vertical feed shaft 7 is reciprocally rotated within a predetermined range through the crank rod in accordance with the aforementioned eccentric cam for the vertical feed, motions in a vertical direction are imparted to the feed dog 10 through the aforementioned feed bar 8.

Figure 4:
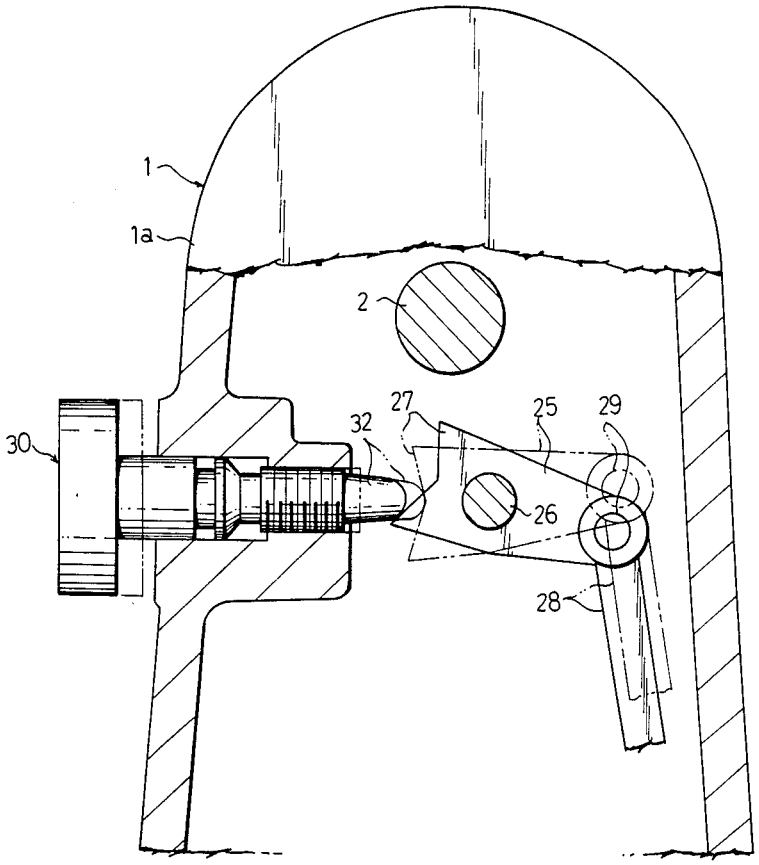

In the arm 1*a* of the machine frame 1, as shown in FIG. 4, there is rotatably supported, by a pivot pin 26, a feed adjustor 25 which is rotationally biased clockwise of FIG. 4 by the action of a not-shown spring and which is formed with a V-shaped feed control cam 27 at its front side. To the rear side of the feed adjustor 25, there is fitted in a rocking manner, by a screw 29, the upper end of a connecting lever 28, which has its lower end connected in a rocking manner to the support pin 19 fixed on the aforementioned feed switch 16, as shown in FIGS. 2 and 3. As shown in FIG. 4, moreover, in front of the aforementioned feed adjustor 25, there is screwed in the arm 1*a* of the machine frame 1 a manual adjusting lever 30 which is provided at its inner end with a holding portion 32 engageable with the feed control cam 27 of the feed adjustor 25 for regulating and holding that feed adjustor 25 in a predetermined position against the action of the aforementioned spring.

By the aforementioned spring action, moreover, the feed adjustor 25 is positioned, as indicated by solid lines in FIG. 4, and the connecting lever 28 is pushed down so that the aforementioned feed switch 16 is arranged, as shown in FIG. 3(*a*), in a lower rocked position having a large work feed pitch. As a result, when, in this state, the feed adjustor 25 is rocked counter-clockwise, as indicated by broken lines in FIG. 4, by the turning actuation of the manual actuating lever 30 against the spring action, the feed switch 16 is rocked clockwise of FIG. 3(*a*) through the rise of the aforementioned connecting lever 28. As a result, as the axis of the support pin 19 on the feed switch 16 approaches the closer to a straight line L—L joining the axes of the connecting pin 20 and the pin 23, as shown in FIG. 3(*b*), the work feeding pitch becomes the smaller. The work feeding direction is reversed when the axis of the support pin 19 moves upward across the straight line L—L, as shown in FIG. 3(*c*).

In the arm 1*a* of the machine frame 1, as shown in FIG. 2, there is supported in a rocking manner an actuating shaft 34 which extends to the right and left above the aforementioned feed switch 16 to have its righthand end carrying thereon an actuating lever 37 exposed to the outside of the arm 1*a*. On the lefthand end of the actuating shaft 34, on the other hand, there is fixed an actuating arm 35 which has its rear end connected in a rocking manner to an intermediate portion of the aforementioned connecting lever 28 by means of a screw 36. When, moreover, the actuating shaft 34 is rocked clockwise of FIG. 4 by the pushing action of the actuating lever 37, the aforementioned feed switch 16 is rotated to its reversing position, as shown in FIG. 3(*c*), through the actuating arm 35 and the connecting lever 28 so that the work feeding direction is reversed.

At the back of the actuating shaft 34, moreover, there is arranged in the arm 1*a* of the machine frame 1 a servo solenoid 38 which has an armature 39 connected operatively to the actuating shaft 34 through a connecting member 40. When the actuating shaft 34 is rotated in a predetermined stroke clockwise of FIG. 2 in accordance with the forward protrusion of the armature 39, moreover, the feed switch 16 is rocked in a direction to reduce the work feed, as shown in FIG. 3(*b*), through the actuating arm 35 and the connecting lever 28 so that the work feeding pitch is reduced and corrected.

On the front face of the arm 1*a* of the machine frame 1, as shown in FIG. 1, there is mounted a projecting element 51*a* which is positioned closer to the work feeding side of the sewing machine than the sewing point. Closer to the work feeding side than the sewing point, moreover, there is disposed in the bed 1*b* a receiving element 51*b* for receiving an optical beam emitted from the aforementioned projecting element 51*a*. These projecting and receiving elements 51*a* and 51*b* constitute together a work end detector 51. When the work fabric is passed between these two elements to open the optical path of the same, the end of the fabric is detected by means that the receiving element 51*b* directly receives the optical beam from the projecting element 51*a*, so that the receiving element 51*b* outputs a work end detection signal.

Between the aforementioned feed bar 8 and feed switch 16, on the other hand, there is fixed on the aforementioned horizontal feed shaft 6 a detected member 42 which is formed with a number of slits 41. In the bed 1*b* of the machine frame 1, moreover, there is disposed a photo interruptor 43 which is positioned to correspond to that detected member 42. And, these detected member 42 and photo interruptor 43 constitute together a signal generator 44 to output a signal of a pulse number corresponding to the reciprocating stroke of the horizontal feed shaft 6.

Figure 5:
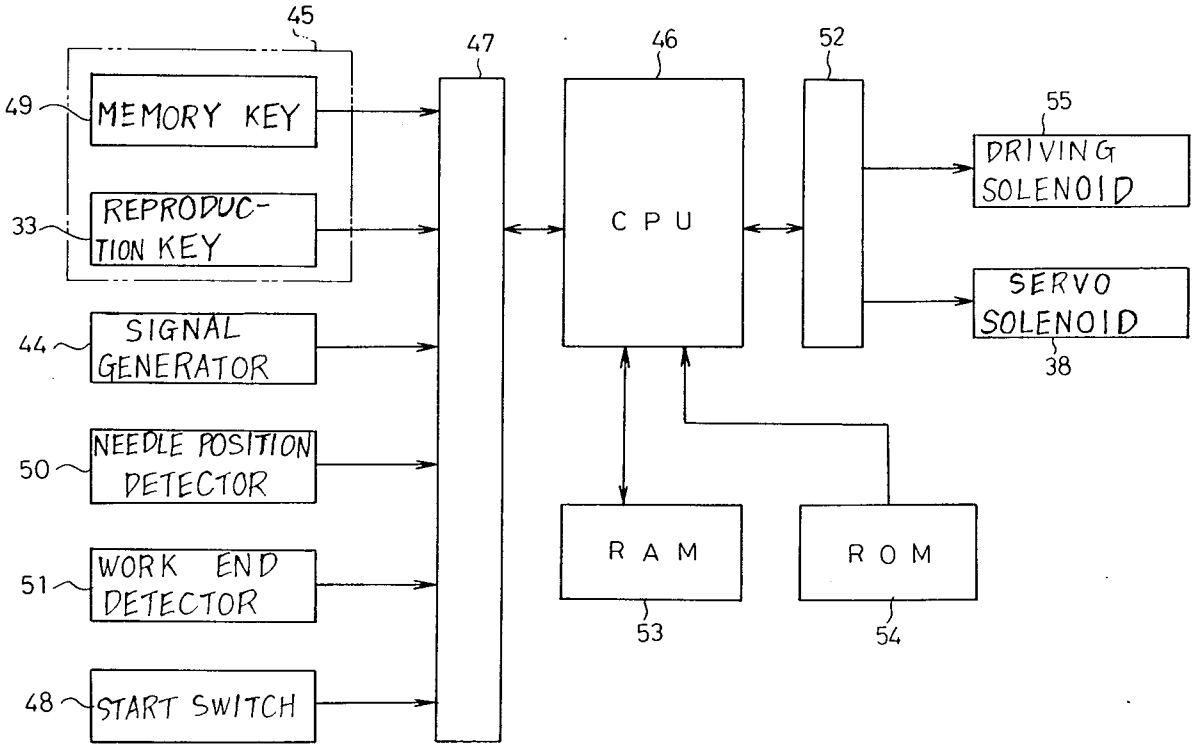

Next, the control circuit of the playback sewing machine in the present embodiment will be described in the following with reference to FIG. 5. With a central processing unit (CPU) 46 acting as control means, there are connected through an input interface 47 a start switch 48, the aforementioned signal generator 44, a needle position detector 50, the aforementioned work end detector 51, and a memory key 49 and a reproduction key 33 disposed on a control panel 45. When in trial and reproductive sewing operations, moreover, the pulse numbers outputted from the aforementioned signal generator 44 in accordance with the reciprocating rotations of the aforementioned horizontal feed shaft 6 after the work end detection of the main shaft 2 are added by the CPU 46.

With the CPU 46, on the other hand, there are connected through an output interface 52 a driving solenoid 55 for applying and releasing a clutch mechanism, which is incorporated in a drive transmission between the main shaft 2 and the motor 13, and the aforementioned servo solenoid 38 which is associated with the aforementioned work end detector 51 for reducing and correcting the work feed pitch at the sewing end portion.

With the CPU 46, there are also connected a random access memory (RAM) 53 and a read only memory (ROM) 54. Moreover, the RAM 53 and the aforementioned memory key 49 constitute together setting means. When in the trial, the sewing operation of one pattern is ended, the aforementioned memory key 49 is operated. Then, the CPU 46 stores and sets the RAM 53 with the added value of the pulse numbers, which come from the signal generator 44 after the work end detection by the aforementioned work end detector 51, as the seam length data of the work end portion in the teaching mode of operation. When the aforementioned reproduction key 33 is operated, the play back sewing mode is set so that the CPU 46 subtracts the pulse number, which is outputted by the signal generator 44 after the work end detection when in the play back sewing operation, from the aforementioned stored pulse number. When this subtracted value reaches a predetermined value, the CPU 46 outputs a drive signal for reducing the work feeding pitch to the aforementioned servo solenoid 38. Incidentally, the ROM 54 is stored with a program for controlling the playback sewing machine as a whole.

Figure 6:
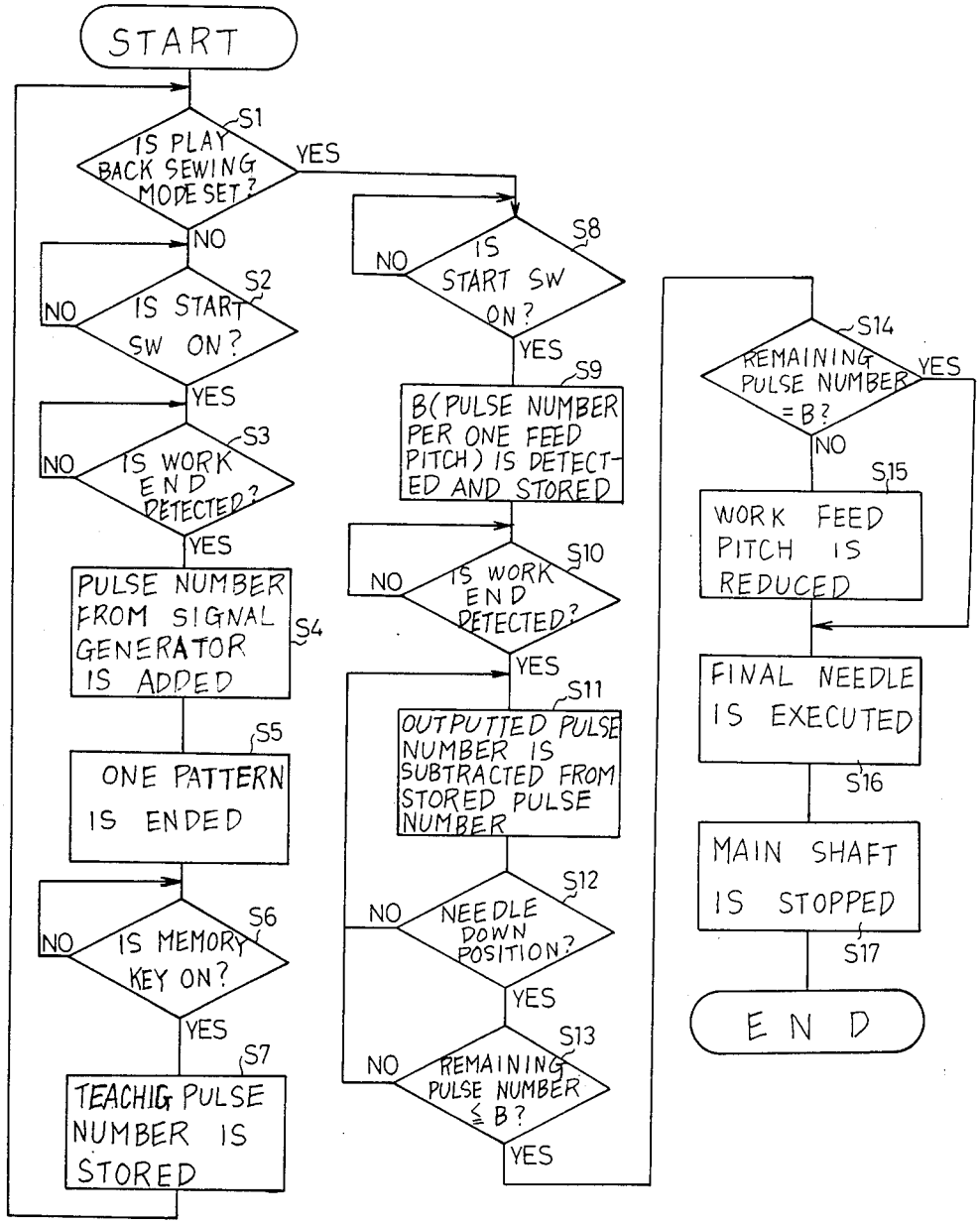

Next, the operations of this playback sewing machine will be described with reference to FIG. 6. At a step S1, it is judged whether or not the play back sewing mode is set by the operation of the aforementioned reproduction key 33. Moreover, if the operation of the start switch 48 is confirmed at a step S2 in case the reproduction key 33 is not operated, i.e., in case the teaching mode is set, the sewing operation by the sewing needle 5 is executed together with the work feed by the feed dog 10. Then, if the work end is detected at a step S3 by the aforementioned work end detector 51, the pulse number from the signal generator 44 corresponding to the reciprocating stroke of the horizontal feed shaft 6 after the work end detection is added at a step S4. Next, the sewing operation of one pattern is ended at a step S5, and the operation of the aforementioned memory key 49 is confirmed at a step S6. Then, the pulse number corresponding to the seam length after the work end detection of the teaching mode on operation and added at the previous step S4 is stored and set in the RAM 53 at a step S7, and the operations are then returned to the step S1.

Subsequently, if the play back sewing mode is set at the step S1 by the operation of the reproduction key 33 and if the operation of the start switch 48 is confirmed at a step S8, the play back sewing operation is executed on the basis of the sewing data for the teaching mode on operation. At a step S9, moreover, the pulse number (which is denoted at B in FIG. 7) per one work feed pitch is detected on the basis of the pulse number outputted from the signal generator 44 for a time period from a needle-up signal to a subsequent needle-up signal of the aforementioned needle position detector 50, and its value is stored in the RAM 53. If the work end is subsequently detected (in the state of FIG. 7) at a step S10 by the work end detector 51, the operations proceed to a step S11, at which the number of pulses outputted from the signal generator 44 after that work end detection, is subtracted from the aforementioned stored pulse number. After this, the down position of the needle 5 is confirmed at a step S 12 on the basis of a needle-down signal coming from the needle position detector 50.

At a step S13, it is judged whether or not the remaining pulse number after the subtraction at the previous step S11 is smaller than the aforementioned pulse number B per one work feeding pitch. If NO, the operations are returned to the step S11 so that the aforementioned subtraction and confirmation of the needle-down position are repeated. Next, at a step S14, it is judged whether or not the aforementioned remaining pulse number is coincident with the pulse number B per one work feeding pitch. If YES, the operations proceed to a step S16, at which the sewing operation of the final needle is executed with the same work feeding pitch as the previous one. After this, the sewing thread is cut, and a drive stopping signal is outputted at a step S17 to the aforementioned driving solenoid 55 to stop the rotations of the main shaft 2.

If the aforementioned remaining pulse number is smaller than the pulse number B per one work feeding pitch, on the contrary, the operations proceed to a step S15, at which the armature 39 of the aforementioned servo solenoid 38 is driven to proceed in response to the drive signal based on the remaining pulse number so that the feed switch 16 is rocked through the actuating shaft 34, the actuating arm 35 and the connecting lever 28 in a direction to reduce the work feeding stroke or pitch, as shown in FIG. 3(*b*). Subsequently, the work fabric W is finally sewn at the step S16 with the reduced work feeding pitch (which is denoted at B' in FIG. 7). After this, the sewing thread is cut, and the rotations of the main shaft 2 are stopped at the step S17.

Incidentally, in the playback sewing machine of the present embodiment, the sewing operation of a predetermined seam length (as denoted at A in FIG. 7) from the work end portion detected by the work end detector 51 to the sewing end position is performed. This can always retain a constant margin to seam (as denoted at C in FIG. 7) even in case the work fabric W is different in size. In this case, moreover, since the signal generator 44 is mounted on the horizontal feed shaft 6 in the vicinity of the feed dog 10, a substantially one-to-one correspondence can be attained between the feed dog 10 and the horizontal feed shaft 6, even in case the sewing machine is shifted from high- to low-speed operations after the work end detection during the play back sewing operation, so that the actual work feed by the feed dog 10 can be accurately detected on the basis of the pulse number coming from the signal generator 44. Since the final stitch is executed with the reduced work feeding pitch, moreover, the sewing operation can be ended in the accurate sewing ending position which is neither excessive nor short in comparison with the sewing ending position for the teaching mode on operation. Since the signal generator 44 is positioned closer to the feed dog 10 than the feed switch 16, still moreover, it is possible to detect such a rocking stroke of the horizontal feed shaft 6 as will vary in accordance with the work feeding pitch adjusted. This enables the CPU 46 to use the pulses outputted from the signal generator 44 as they are as its arithmetic data irrespective of the change in the pitch and to execute such a simple sequence as requires no correcting program.

In the foregoing description of the operations, incidentally, the servo solenoid 38 is operated when the remaining pulse number reaches a value smaller than the pulse number B corresponding to one pitch. As the pitch number providing a reference for comparison is set at the larger value such as two, three or four pitches, the number of stitches to be reduced becomes the larger so that a sewing operation of fixed seam can be conducted to provide a beautiful sewn work.

(Second Embodiment)

Figure 9:
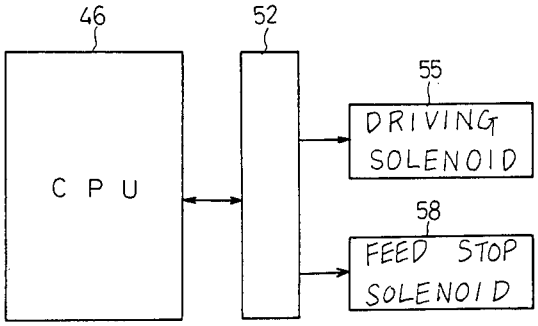
Figure 10:
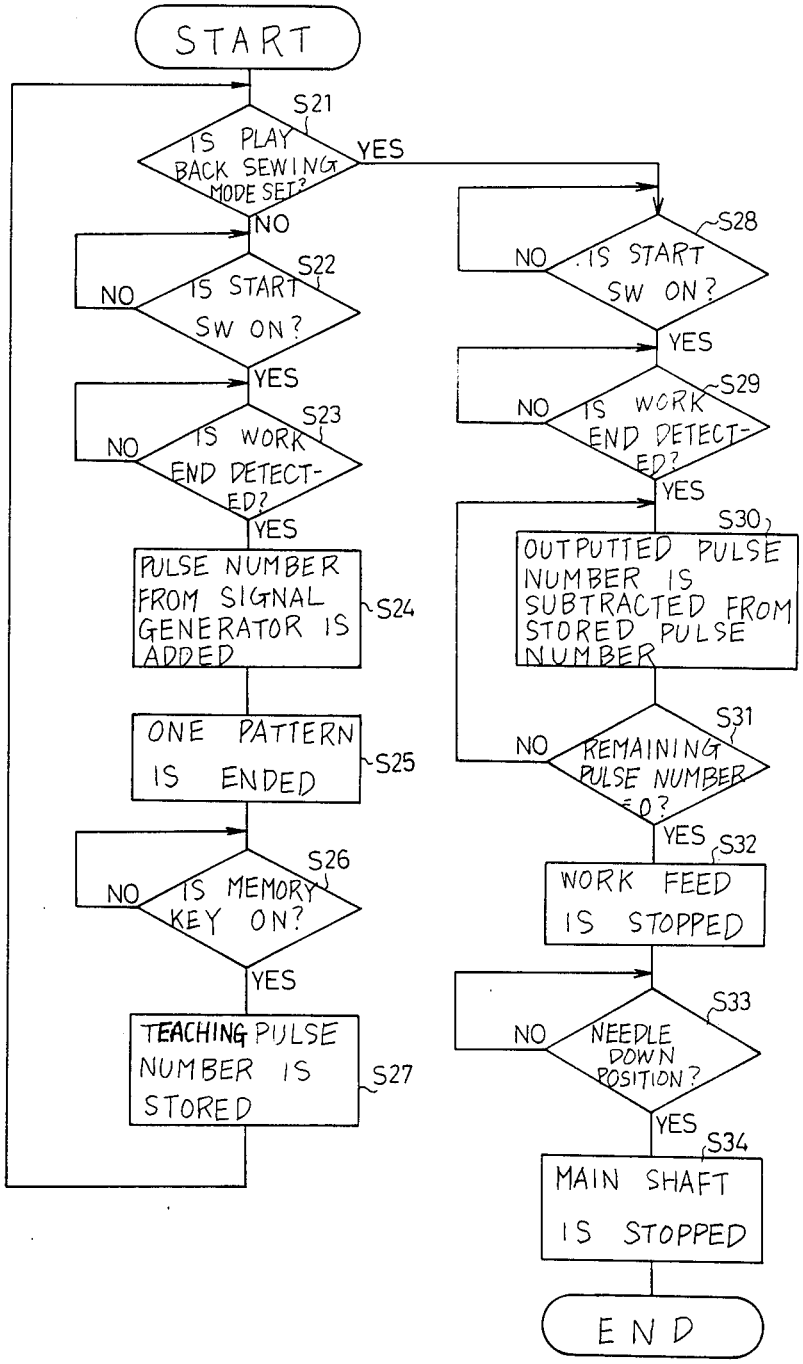

Next, the present invention will be described in connection with its second embodiment embodying the playback sewing machine with reference to FIGS. 8 to 10. This second embodiment is different from the foregoing first embodiment only in the construction in which the work feeding pitch of the final stitch is changed.

Figure 8:
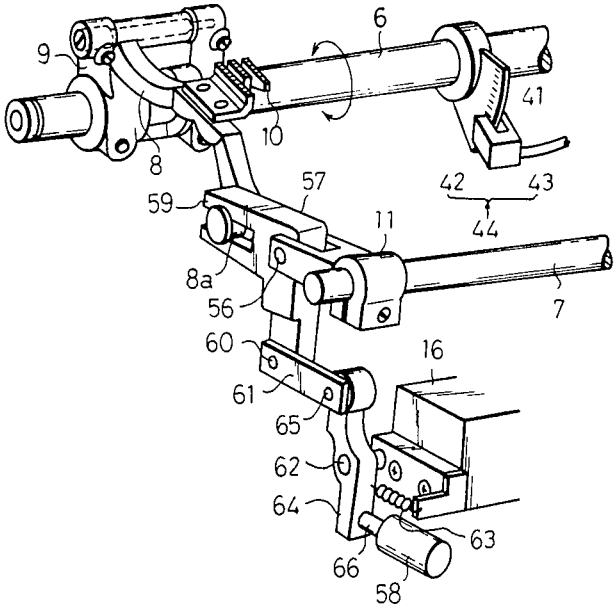
In FIGS. 8 to 10 showing a second embodiment embodying the present invention.

As shown in FIG. 8, more specifically, on the bifurcated arm 11 fixed on the aforementioned vertical feed shaft 7, there is supported through a pin 56 a L-shaped rocker lever 57 which has its one end bifurcated at 59 and fitted on the engagement portion 8*a* of the aforementioned feed bar 8. A link 61 has its one end hinged to the other end of the rocker lever 57 by means of a pin 60. On a pivot pin 62 fixed in the bed 1*b* of the machine frame 1, on the other hand, there is supported in a rocking manner an intermediate portion of an actuating lever 64, which is always urged counter-clockwise of FIG. 8 by the action of a spring 63. That actuating lever 64 has its upper end connecting the other end of the aforementioned link 61 through a pin 65 and its lower end forced to contact with an armature 66 of a feed stop solenoid 58, which is disposed in the bed 1*b*, by the action of the aforementioned spring 63.

Moreover, the armature 66 of the aforementioned feed stop solenoid 58 is always in its retracted position. When, in this state, the vertical feed shaft 7 is reciprocally rotated in association with the main shaft 2, the rocker lever 57 is rocked up and down in a fixed angular position relative to the bifurcated arm 11 so that the feed dog 10 comes inward and outward from the upper surface of the bed 1*b* through the feed bar 8. As a result, the work fabric is intermittently fed by the association between those inward and outward motions and the horizontal motions of the feed dog 10 following the reciprocal rotations of the aforementioned horizontal feed shaft 6. In the reprodusive sewing operation, on the other hand, when the pulse number outputted from the aforementioned signal generator 44 after the work end detection reaches the pulse number corresponding to the set seam length, a drive signal is outputted from the CPU 46 to the aforementioned feed stop solenoid 58, as shown in FIG. 9, to protrude the armature 66. As a result, the rocker lever 57 is rocked counterclockwise through the link 61 in accordance with the rocking motion of the actuating lever 64 in the clockwise direction of FIG. 8 so that the engagement portion 8*a* of the feed bar 8 is pushed down to bring the feed dog 10 inward from the upper surface of the bed 1*b*. As a result, the aforementioned work feeding action of the feed dog 10 is made ineffective to instantly stop the feed of the work fabric.

Next, the operations of the playback sewing machine according to the present embodiment will be described with reference to FIG. 10.

At steps S21 to S27, the sewing data accompanying the teaching mode operation is stored like the foregoing first embodiment. If the play back sewing mode is set at the step S21 by operating the reproduction key 33 and if the operation of the start switch 48 is confirmed at a step S28, the play back sewing operation is started. If the work end is then detected at a step S29, the number of pulses outputted by the signal generator 44 in accordance with the play back sewing operation is subtracted at a step S30 from the stored pulse number corresponding the aforementioned set seam length. At a subsequent step S31, it is confirmed whether or not the remaining pulse number after the subtraction is zero. If YEs, a drive signal is outputted at a step S32 to the aforementioned feed stop solenoid 58 so that the feed dog 10 is brought downward to instantly stop the feed of the work fabric. If the down position of the needle 5 is confirmed at a subsequent step S33 by the aforementioned needle position detector 50, the thread cut is executed at a step S34. After this, a drive stop signal is outputted to the aforementioned driving solenoid 55 to stop the rotations of the main shaft 2.

Figure 7:
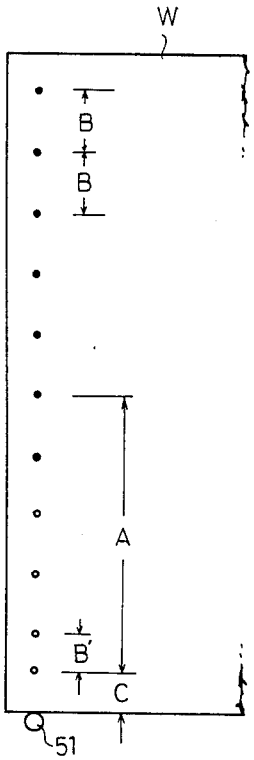

Therefore, in this second embodiment, too, the seam length (which is denoted at A in FIG. 7) after the work end detection when in the play back sewing operation is accurately detected like the foregoing first embodiment on the basis of the signal which corresponds substantially one-to-one to the work feed outputted from the signal generator 44. As a result, at the instant when the seam length becomes coincident with the set value when in the teaching mode on operation, the work feed by the feed dog 10 is stopped to form a reduced stitch of a pitch B′ on the work fabric W sewn, as shown in FIG. 7, so that the play back sewing operation of neither excessive nor short seam length can be executed.

Figure 11:
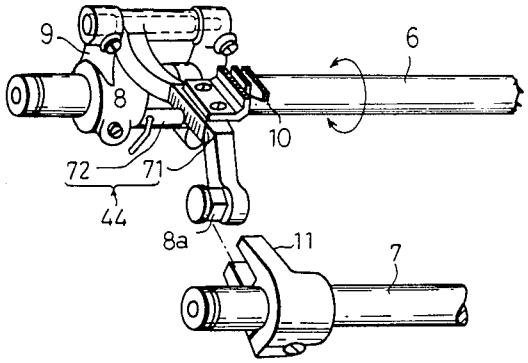
In FIGS. 11 to 13 showing signal generators of different types carried on a feed bar.
Figure 12:
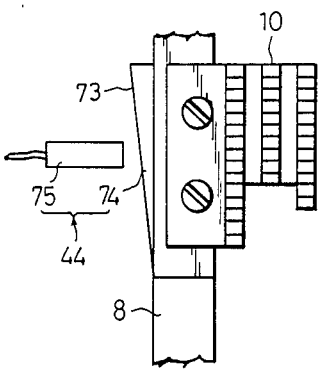
Figure 13:
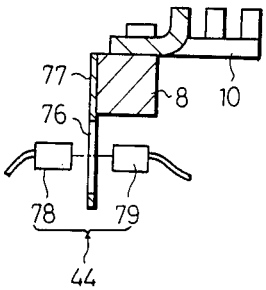

FIGS. 11 to 13 show modifications of the present invention, in which respective signal generators are disposed in such positions as can detect the momentums of the feed bar 8 in the horizontal direction.

As shown in FIG. 11, a band-shaped portion 71 to be detected, which is made of a magnetic recording medium, is placed on the righthand side of the aforementioned feed bar 8, and a magnetic sensor 72 is so fixed in the bed 1*b* of the machine frame 1 as to face that detected portion 71. Moreover, the detected portion 71 and the magnetic sensor 72 constitute together the signal detector 44 to output a signal synchronized with the horizontal motions of the feed dog 10 moving integrally with the feed bar 8.

As shown in FIG. 12, there is fixed on one side of the aforementioned feed bar 8 a member 74 to be detected, which is formed with a slope 73 inclined with respect to the horizontal moving direction of the feed dog 10. A Hall element 75 is so arranged in the bed 1*b* as to face that detected member 74. Those two members 73 and 74 constitute together the signal generator 44.

As shown in FIG. 13, there is fixed on one side of the feed bar 8 a plate 77 to be detected, which is formed with a number of slits 76 and which extends in the logitudinal direction of the feed bar 8. Projecting and receiving elements 78 and 79 are so arranged at the two sides of the detected plate 77 as to constitute together the signal generator 44. A linear encoder can also be used as another signal generator.

The present invention can also be embodied by such a control unit for providing seam length control of a sewing machine as is not equipped with the work end detector. In this embodiment, the CPU compares the pulse number corresponding the desired total seam length and the pulse number outputted by the signal generator after the start of the sewing machine and operates changing means similar to that of the foregoing embodiments, when the compared value reaches a predetermined value, to change the feeding pitch of at least of the final stitch. The present invention can be further applied to an input type sewing machine which is caused to store and set a desired seam length by operating the setting keys on the control panel.

As many apparently widely different embodiments of the present invention may be made without departing from the spirit and scope thereof, it is to be understood that the invention is not limited to the specific embodiments thereof except as defined in the appended claims.

What is claimed is:

1. In a sewing machine comprising a main shaft; a sewing needle for forming stitches in a work fabric which is placed on a work supporting surface, said needle being movable as a function of the rotation of said main shaft; a feed dog for feeding said work fabric as it passes a sewing point of said sewing needle; a work feed mechanism including a feed bar supported by a feed shaft and carrying said feed dog, said work feed mechanism being adapted to impart motions in a feeding direction to said feed dog by the reciprocating rotation of said feed shaft as a function of the rotation of said main shaft; and mechanical adjusting means interposed between said work feed mechanism and said main shaft for adjusting a feed pitch of said feed dog by changing the reciprocating stroke of said feed shaft, the improvement comprising a control unit for providing seam length control, comprising:

means setting a predetermined seam length;

a signal generator on said work feed mechanism between said feed dog and said feed shaft for generating a signal corresponding to the moving stroke of said feed dog in the feed direction;

means for comparing the signal output from said signal generator with a signal corresponding to said set seam length; and means for changing the feed pitch of at least a final seam when the compared value reaches a predetermined value.

2. The sewing machine of claim 1, wherein said sewing machine has a teaching mode and a play back mode, and said setting means includes means for storing a signal output from said signal generator when in the teaching mode during operation of said sewing machine, and wherein said comparing means includes means for comparing a signal output from said signal generator when in the play back sewing operation of said sewing machine with the signal stored when in said teaching mode during operation.

3. In a sewing machine comprising a main shaft; a sewing needle movable as a function of the rotation of said main shaft for forming stitches in a work fabric which is placed on a work supporting surface so that it may be sewn; a feed dog for feeding said work fabric as it passes a sewing point of said sewing needle; a work feed mechanism including a feed bar for carrying said feed dog and a feed shaft for supporting said feed bar said work feed mechanism being adapted to impart motions in a feeding direction to said feed dog by the reciprocating rotation of said feed shaft as a function of the rotation of said main shaft; and mechanical adjusting means interposed between said work feed mechanism and said main shaft for adjusting a feed pitch of said feed dog by changing the reciprocating stroke of said feed shaft, the improvement comprising a control unit for providing seam length control, comprising:

a work end detector for detecting the end of said work fabric at a position closer to a work feeding side of said sewing machine than said sewing point;

means for setting the length of said work fabric from the end to the sewing end position thereof;

a signal generator on said work feed mechanism between said feed dog and said feed shaft for generating a signal corresponding to the moving stroke of said feed dog in the feed direction;

means for comparing the signal output from said signal generator after the detection of said work end with a signal corresponding to said set length; and means for changing the feed pitch of at least a final seam when the compared value reaches a predetermined value.

4. The sewing machine of claim 3, wherein said sewing machine has a teaching mode and a play back mode, and wherein said setting means includes means for storing a signal output from said signal generator after the detection of said work end when in the teaching mode during operation of said sewing machine, and wherein said comparing means includes means for comparing a signal output from said signal generator after the detection of said work end when in the play back sewing operation of said sewing machine with the signal stored when in said teaching mode during operation.

5. The sewing machine of claim 3, wherein said changing means includes an actuating member for actuating said mechanical adjusting means and control means for controlling said actuating member as a function of said compared value.

6. The sewing machine of claim 5, wherein said comparing means includes means for subtracting the number of pulses output from said signal generator from the number of pulses corresponding to said set length, and wherein said control means includes means for driving said actuating member when said subtracted pulse number becomes smaller than that corresponding to said feed pitch set by said mechanical adjusting means.

7. The sewing machine of claim 5, wherein said actuating member is a servo solenoid.

8. The sewing machine of claim 3, wherein said changing means includes a mechanism for stopping the work feed by retracting said feed dog from said work supporting surface, and control means for actuating said stopping mechanism when the pulse number corresponding to said set length and the pulse number output from said signal generator are coincident.

9. The sewing machine of claim 3, wherein said signal generator is mounted on said feed shaft.

10. The sewing machine of claim 3, wherein said signal generator is carried on said feed bar.

11. In a sewing machine comprising a main shaft; a sewing needle for forming stitches in a work fabric which is placed on a work supporting surface, said needle being movable as a function of the rotation of said main shaft; a feed dog for feeding said work fabric as it passes a sewing point of said sewing needle; a work feed mechanism including a feed bar supported by a feed shaft and carrying said feed dog, said work feed mechanism being adapted to impart motion in a feed direction to said feed dog by the reciprocating rotation of said feed shaft as a function of the rotation of said main shaft; and mechanical adjusting means interposed between said work feed mechanism and said main shaft for adjusting a feed pitch of said feed dog by changing the reciprocating stroke of said feed shaft, the improvement comprising, a control unit for providing seam length control, comprising:

setting means for setting a predetermined seam length;

a signal generator on said work feed mechanism between said feed dog and said feed shaft for generating a signal corresponding to the moving stroke of said feed dog in the feed direction;

comparing means for comparing the signal output from said signal generator with a signal corresponding to said set seam length;

said sewing machine having a teaching mode and a play back mode;

changing means for changing the feed pitch of at least a final seam when the compared value reaches a predetermined value;

said setting means including means for storing a signal output from said signal generator when in the teaching mode during operation of said sewing machine, and said comparing means including means for comparing a signal output from said signal generator when in the play back mode with the signal stored when in said teaching mode during operation.

12. In a sewing machine comprising a main shaft; a sewing needle movable as a function of the rotation of said main shaft for forming stitches in a work fabric which is placed on a work supporting surface so that it may be sewn; a feed dog for feeding said work fabric as it passes a sewing point of said sewing needle; a work feed mechanism including a feed bar for carrying said feed dog and a feed shaft for supporting said feed bar, said work feed mechanism being adapted to impart motion in a feeding direction to said feed dog by the reciprocating rotation of said feed shaft as a function of the rotation of said main shaft; and mechanical adjusting means interposed between said work feed mechanism and said main shaft for adjusting a feed pitch of said feed dog by changing the reciprocating stroke of said feed shaft, the improvement comprising a control unit for providing seam length control, comprising:

a work end detector for detecting the end of said work fabric at a position closer to a work feed side of said sewing machine than said sewing point;

setting means for setting the sewing length of said work fabric between a detecting position of said work end detector and the sewing end position;

a signal generator on said work feed mechanism between said feed dog and said feed shaft for generating a signal corresponding to the moving stroke of said feed dog in the feed direction;

comparing means for comparing the signal output from said signal generator after the detection of said work end with a signal corresponding to said set length;

changing means for changing the feed pitch of at least a final seam when the compared value reaches a predetermined value;

said sewing machine having a teaching mode and a play back mode;

said setting means including means for storing a signal output from said signal generator after the detection of said work end when in the teaching mode during operation of said machine, and said comparing means including means for comparing a signal output from said signal generator after the detection of said work end when in the play back sewing operation of said sewing machine with the signal stored when in said teaching mode during operation.

13. The sewing machine of claim 12, wherein said changing means includes a mechanism for stopping the work feed by retracting said feed dog from said work supporting surface, and control means for actuating said stopping mechanism when the pulse number corresponding to said set length and the pulse number output from said signal generator are coincident.

14. The sewing machine of claim 12 wherein said signal generator is mounted on said feed shaft.

15. The sewing machine unit of claim 12 wherein said signal generator is carried on said feed bar.

16. In a sewing machine comprising a main shaft; a sewing needle movable as a function of the rotation of said main shaft for forming stitches in a work fabric which is placed on a work supporting surface so that it may be sewn; a feed dog for feeding said work fabric as it passes a sewing point of said sewing needle; a work feed mechanism including a feed bar for carrying said feed dog and a feed shaft for supporting said feed carriage, said work feed mechanism being adapted to impart motion in a feeding direction to said feed dog by the reciprocating rotation of said feed shaft as a function of the rotation of said main shaft; and mechanical adjusting means interposed between said work feed mechanism and said main shaft for adjusting a feed pitch of said feed dog by changing the reciprocating stroke of said feed shaft; the improvement comprising a control unit for providing seam length control, comprising:

a work end detector for detecting the end of said work fabric at a position closer to a work feeding side of said sewing machine than said sewing point;

means for setting the sewing length of said work fabric between a detecting position of said work end detector and the sewing end position;

a signal generator mounted on said feed shaft for generating a signal corresponding to the moving stroke of said feed dog in the feed direction;

means for comparing the signal output from said signal generator after the detection of said work end with a signal corresponding to said set length; and means for changing the feed pitch of at least a final seam when the compared value reaches a predetermined value.

17. In a sewing machine comprising a main shaft; a sewing needle movable as a function of the rotation of said main shaft for forming stitches in a work fabric which is placed on a work supporting surface so that it may be sewn; a feed dog for feeding said work fabric as it passes a sewing point of said sewing needle; a work feed mechanism including a feed bar for carrying said feed dog and a feed shaft for supporting said feed bar, said work feed mechanism being adapted to impart motion in a feeding direction to said feed dog by the reciprocating rotation of said feed shaft as a function of the rotation of said main shaft; and mechanical adjusting means interposed between said work feed mechanism and said main shaft for adjusting a feed pitch of said feed dog by changing the reciprocating stroke of said feed shaft; the improvement comprising a control unit for providing seam length control, comprising:

a work end detector for detecting the end of said work fabric at a position closer to a work feed side of said sewing machine than said sewing point;

means for setting the sewing length of said work fabric between a detecting position of said work end detector and the sewing end position thereof;

a signal generator on said feed bar for generating a signal corresponding to the moving stroke of said feed dog in the feed direction;

means for comparing the signal output from said signal generator after the detection of said work end with a signal corresponding to said set length; and means for changing the feed pitch of at least a final seam when the compared value reaches a predetermined value.

* * * * *